US010378730B2

(12) United States Patent
Kinzer et al.

(10) Patent No.: US 10,378,730 B2
(45) Date of Patent: Aug. 13, 2019

(54) CYC LIGHT

(71) Applicant: Electronic Theatre Controls, Inc., Middleton, WI (US)

(72) Inventors: David Kinzer, Baraboo, WI (US); Frank Tornyai, Los Angeles, CA (US)

(73) Assignee: Electronic Theatre Controls, Inc., Middleton, WI (US)

( * ) Notice: Subject to any disclaimer, the term of this patent is extended or adjusted under 35 U.S.C. 154(b) by 219 days.

(21) Appl. No.: 15/342,181

(22) Filed: Nov. 3, 2016

(65) Prior Publication Data

US 2018/0119924 A1 May 3, 2018

(51) Int. Cl.

| | |
|---|---|
| ***F21V 13/04*** | (2006.01) |
| ***F21V 7/06*** | (2006.01) |
| ***F21V 5/04*** | (2006.01) |
| ***F21V 3/00*** | (2015.01) |
| ***F21V 7/00*** | (2006.01) |

(Continued)

(52) U.S. Cl.

CPC ..... *F21V 13/04* (2013.01); *F21V 3/00* (2013.01); *F21V 5/045* (2013.01); *F21V 7/0025* (2013.01); *F21V 7/06* (2013.01); *F21V 5/002* (2013.01); *F21V 7/05* (2013.01); *F21V 23/006* (2013.01); *F21W 2131/406* (2013.01); *F21Y 2103/10* (2016.08); *F21Y 2115/10* (2016.08)

(58) Field of Classification Search

CPC . F21V 13/04; F21V 3/00; F21V 5/045; F21V 7/05; F21V 7/06; F21S 43/00

See application file for complete search history.

(56) References Cited

U.S. PATENT DOCUMENTS

| | | | |
|---|---|---|---|
| 4,293,892 | A | 10/1981 | Plummer |
| 6,220,731 | B1 | 4/2001 | Ryan |

(Continued)

FOREIGN PATENT DOCUMENTS

| | | |
|---|---|---|
| CN | 102080792 | 6/2011 |
| CN | 202032384 | 11/2011 |

(Continued)

OTHER PUBLICATIONS

Search Report from the Intellectual Property Office of the United Kingdom for Application No. 1718201.5 dated Apr. 17, 2018 (1 page).

*Primary Examiner* — Anabel Ton
(74) *Attorney, Agent, or Firm* — Michael Best & Friedrich LLP

(57) ABSTRACT

A cyc light assembly comprising a base having a front opening, a lighting element supported by the base, a first reflector (e.g., a specular reflector) positioned on a rear side of the lighting element, and a lens positioned in the front opening. The lens includes a plurality of cylinder lens portions that preferably are substantially parallel to each other and substantially horizontally oriented. A diffuser can be positioned to cover the front opening. In one embodiment, a central axis of the lighting element intersects the first reflector (e.g., at a midsection). A recycling reflector can be positioned in front of the lens, and side reflectors can be positioned on opposing sides of the lighting element. Preferably, the side reflectors are substantially planar and are angled to diverge from each other toward the front direction and toward an upward direction, away from the lighting element.

19 Claims, 5 Drawing Sheets

(51) Int. Cl.

| | |
|---|---|
| *F21Y 103/10* | (2016.01) |
| *F21Y 115/10* | (2016.01) |
| *F21V 7/05* | (2006.01) |
| *F21W 131/406* | (2006.01) |
| *F21V 5/00* | (2018.01) |
| *F21V 23/00* | (2015.01) |

(56) References Cited

U.S. PATENT DOCUMENTS

| | | | | |
|---|---|---|---|---|
| 8,152,332 | B2 | 4/2012 | Ryan | |
| 8,388,178 | B2 * | 3/2013 | Ryan | 362/217.05 |
| 8,746,934 | B2 | 6/2014 | Richardson | |
| 2006/0077683 | A1 * | 4/2006 | Muller | B60Q 1/0052 362/544 |
| 2009/0231855 | A1 | 9/2009 | Esakoff et al. | |
| 2010/0118528 | A1 * | 5/2010 | Ryan | 362/231 |
| 2012/0250315 | A1 | 10/2012 | Ryan | |
| 2013/0272009 | A1 * | 10/2013 | Fujiu | B60Q 1/0058 362/517 |
| 2014/0098554 | A1 * | 4/2014 | Schimon | F21S 43/00 362/512 |
| 2014/0247602 | A1 | 9/2014 | Kinzer et al. | |
| 2014/0268721 | A1 * | 9/2014 | Durkee | F21V 13/04 362/218 |
| 2016/0040850 | A1 * | 2/2016 | Orisich | B60Q 1/34 362/511 |
| 2018/0087734 | A1 * | 3/2018 | Miller | F21S 41/24 |
| 2018/0290587 | A1 * | 10/2018 | Fimeri | B60Q 1/2665 |

FOREIGN PATENT DOCUMENTS

| | | |
|---|---|---|
| CN | 102927502 | 2/2013 |
| CN | 103383087 | 11/2013 |

* cited by examiner

CYC LIGHT

BACKGROUND

The present invention relates to theatre lighting, and specifically to cyclorama ("Cyc") lights.

Cyc lights are commonly used to provide a broad wash of light to a cyclorama, which is a large curtain or wall positioned near the back of a theatre stage. Cyc lights typically have a light source positioned near a J-shaped reflector, which allows the cyc light to be positioned relatively near the cyclorama and still cast a broad sheet of light.

SUMMARY

The present invention provides a cyc light assembly comprising a base having a front direction defined by a front opening and a rear direction opposite the front direction, a lighting element supported by the base and defining a central axis, a first reflector (e.g., a specular reflector) positioned on a rear side of the lighting element to reflect light toward the front opening, and a lens positioned in the front opening and adapted to bend light from the first reflector. The lens includes a plurality of cylinder lens portions. Preferably, the cylinder lens portions are substantially parallel to each other and are substantially horizontally oriented.

The cyc light assembly can further include a diffuser positioned to cover the front opening. For example, the lens can be positioned between the light source and the diffuser. In one embodiment, the central axis intersects the first reflector and does not intersect the front opening. The intersection of the central axis with the first reflector preferably occurs in a mid-section (e.g., the middle 50% of the length of the first reflector, preferably the middle 33%, and more preferably substantially at the midpoint). The cyc light can further include a recycling reflector positioned in front of the lens and adapted to collect light that is otherwise wasted. Preferably, a portion of the recycling reflector is aligned with a portion of the first reflector.

If desired, the cyc light assembly can further include a second reflector positioned on a front side of the lighting element to reflect diffuse light toward the front opening (i.e., the second reflector being more diffuse than the first reflector). In one embodiment, the first reflector includes a curved portion and the second reflector includes a substantially planar portion. For example, the central axis of the lighting element can be substantially perpendicular to the substantially planar portion of the second reflector. Preferably, the second reflector includes a first substantially planar portion positioned adjacent the lighting element and a second substantially planar portion positioned adjacent the lens.

The cyc light assembly can also include side reflectors positioned on opposing sides of the lighting element to capture and redirect light traveling towards sides of the light assembly. Preferably, the side reflectors are substantially planar and are angled to diverge from each other toward the front direction and toward an upward direction away from the lighting element.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
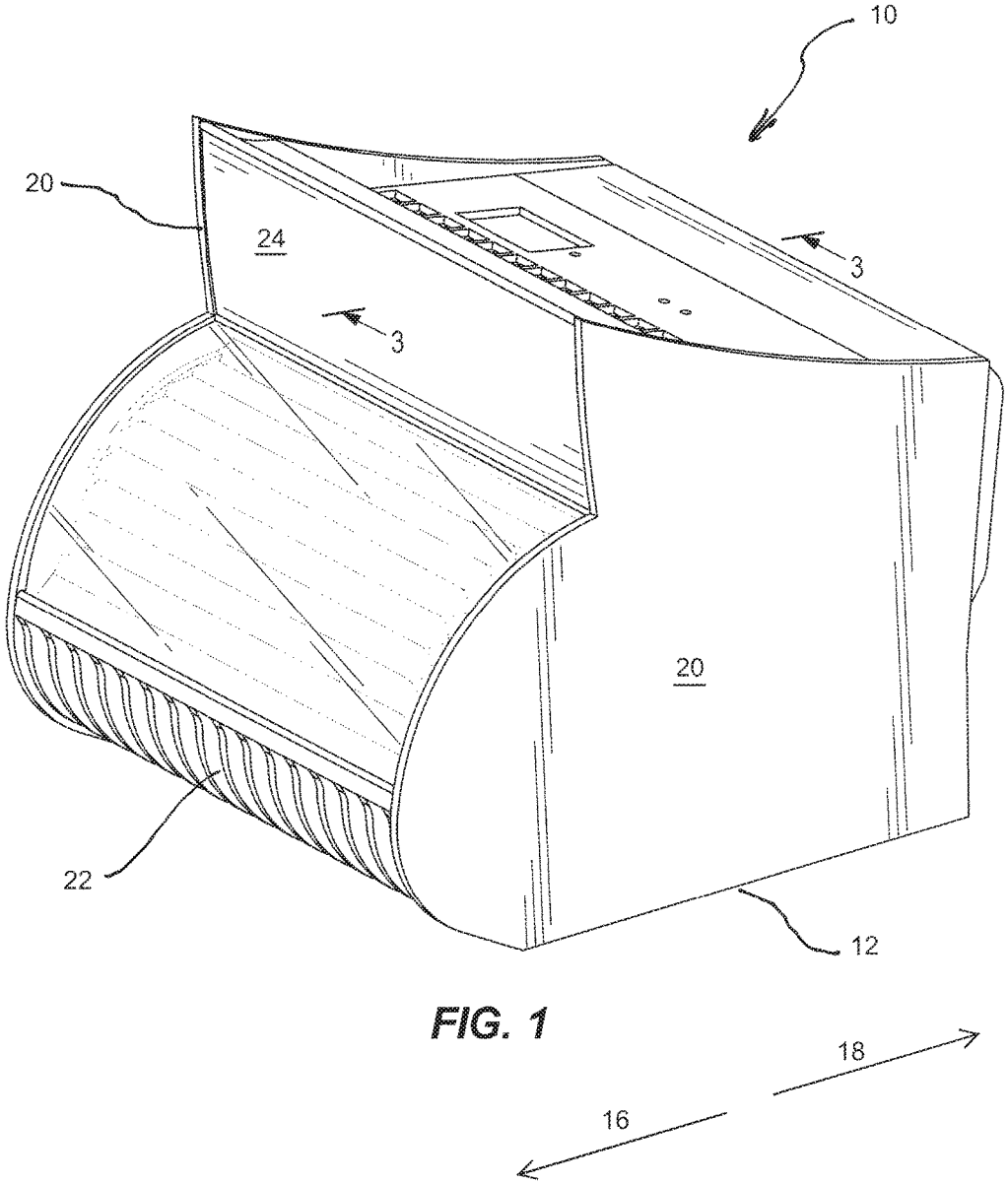
FIG. 1 is a perspective view of a cyc light embodying the present invention.
Figure 2:
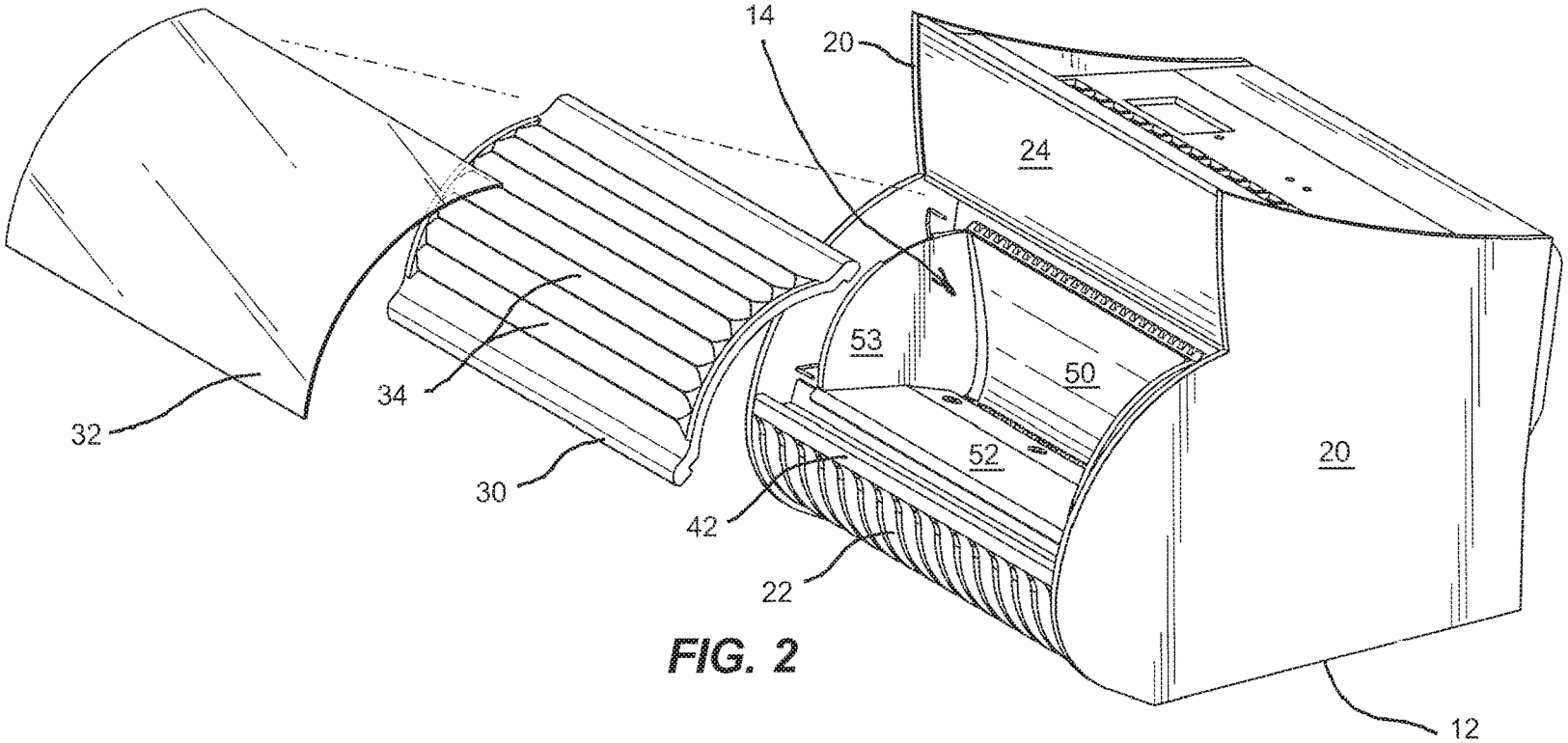
FIG. 2 is a partially exploded view of the cyc light of FIG. 1.
Figure 3:
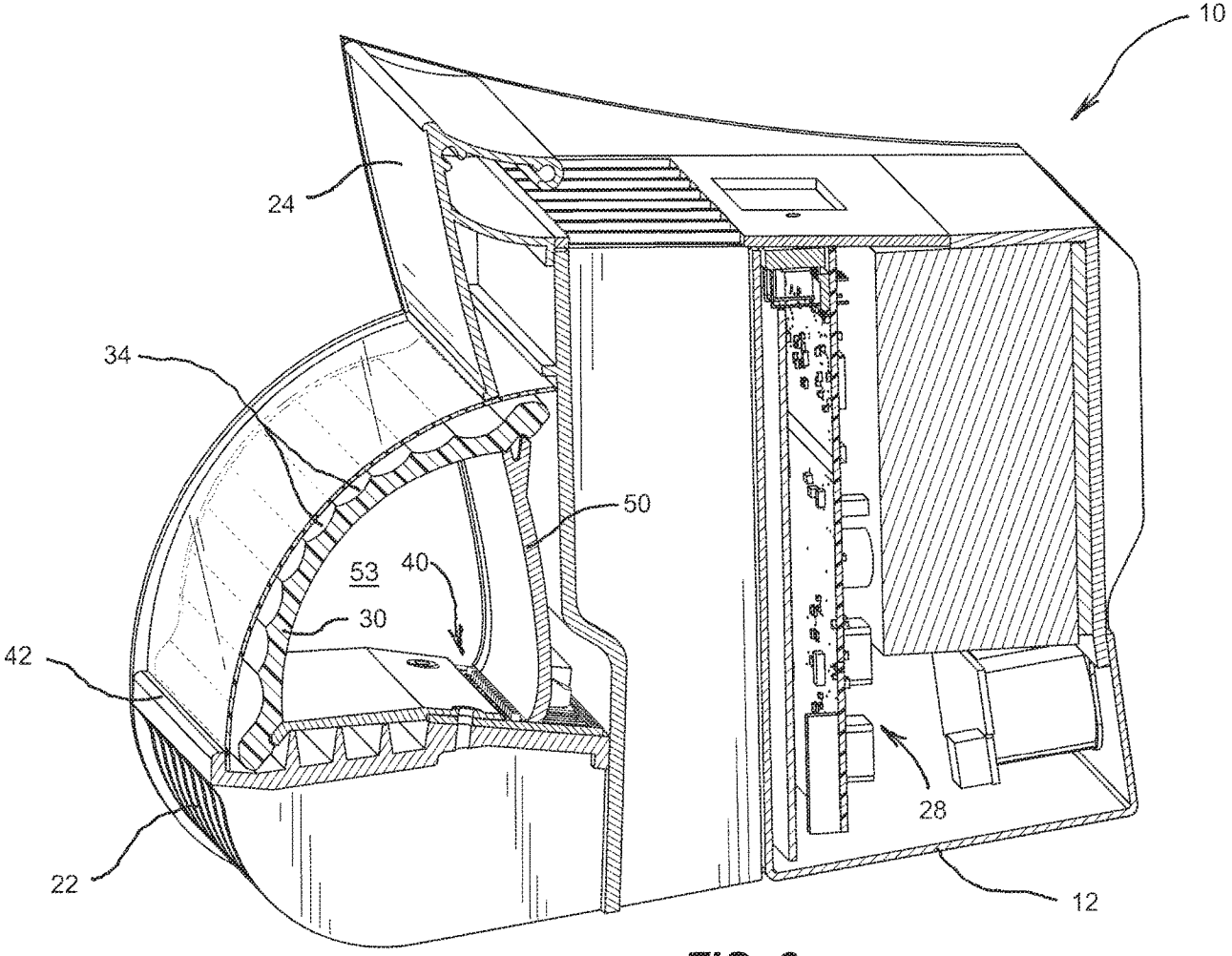
FIG. 3 is a section view taken along line 3-3 in FIG. 1.
Figure 4:
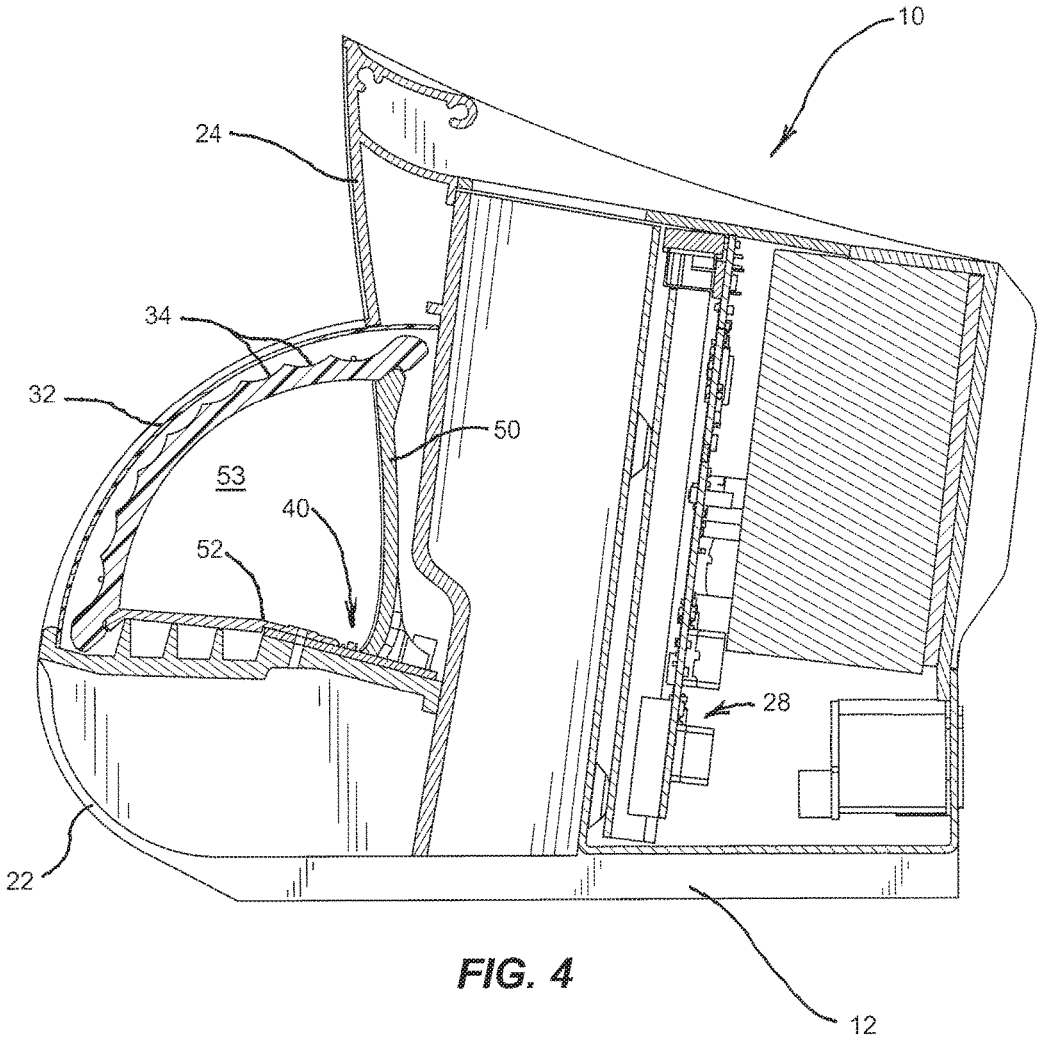
FIG. 4 is a side view of the section view of FIG. 3.

FIGS. 1-5 illustrate a cyc light assembly 10 having a base 12 that includes a front opening 14 (see FIG. 2) defining a front direction 16 that is opposite to a rear direction 18. In the illustrated embodiment, the front opening 14 is defined by side walls 20, a lower front wall 22, and a recycling reflector 24. Referring to FIGS. 3 and 4, electronics 28 are mounted in a rear portion of the base 12.

Referring to FIG. 2, the cyc light assembly 10 further includes a lens 30 covering the front opening 14 and a diffuser 32 covering the lens 30. The diffuser 32 smears the light, creating a smooth light distribution. The illustrated lens 30 includes a series of cylinder lens portions 34 extending horizontally and stacked vertically. There are a sufficient number of cylinder lens portions 34 that the beam on the cyclorama from each cylinder overlaps the beams from its neighboring cylinders.

Figure 5:
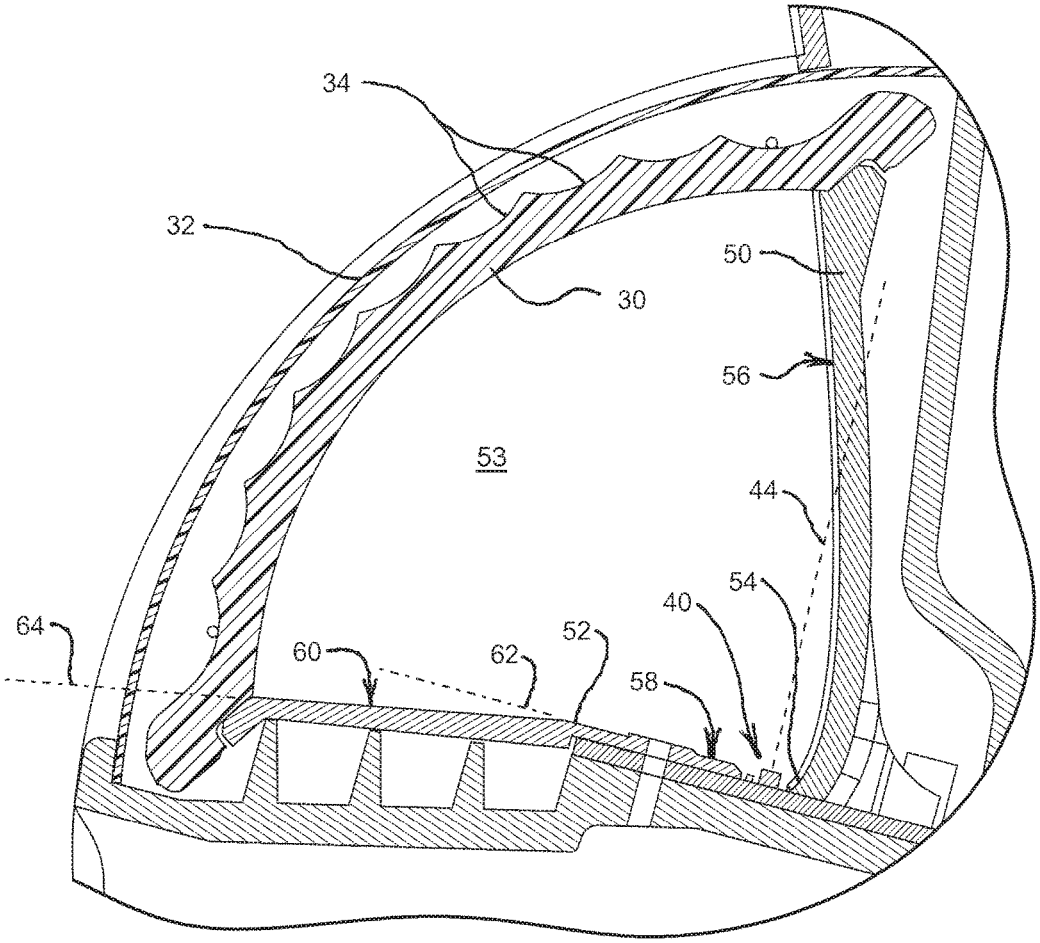
FIG. 5 is an enlarged view of the cyc light of FIG. 4.

Referring FIGS. 3-5, a series of lighting elements in the form of LEDs 40 are positioned in the base 12 and behind the lens 30. The illustrated LEDs 40 are arranged is a row that is parallel to a front edge 42 defining the front opening 14 and also parallel to a longitudinal orientation of the cylinder lens portions 34. Referring to FIG. 5, each LED 40 produces light defining a central axis 44, as determined by the light's Lambertian distribution. As best shown in FIG. 5, the central axes 44 do not go through the front opening 14 of the base 12.

The cyc light assembly 10 further includes a specular reflector 50 positioned rearward of the LEDs 40 and behind the lens 30, a diffuse reflector 52 positioned forward of the LEDs 40 and behind the lens 30, and side reflectors 53 on both sides of the LEDs 40. A lower edge 54 of the specular reflector 50 is positioned adjacent and immediately rearward of the LEDs 40, and a reflecting surface 56 of the specular reflector 50 curves upward and forward to intersect the central axes 44 of the LEDs 40. The curved shape of the specular reflector 50 is a parabolic trough.

As best shown in FIG. 5, the central axes 44 of the LEDs 40 in the illustrated embodiment are arranged to intersect a midsection (e.g., the middle 50% of the length) of the specular reflector 50, such as a midpoint about half way between the lower edge 54 and the upper edge where the specular reflector 50 intersects the lens 30. Because light reflecting off of the specular reflector 50 generally illuminates the upper part of the cyclorama, this arrangement (with the central axes 44 intersecting a midpoint of the specular reflector 50) has been found to provide much-needed light to the upper part of the cyclorama, which helps to provide a more uniform light pattern on the cyclorama.

The illustrated diffuse reflector 52 includes a first planar portion 58 positioned adjacent the LEDS 40 and a second planar portion 60 positioned between the first planar portion 58 and the lens 30. The first planar portion 58 defines a first reflective plane 62 that is substantially perpendicular to the central axes 44, and the second planar portion 60 defines a second reflective plane 64 that is at an angle α of about 10 degrees relation to the first reflective plane 62. As shown in FIG. 5, the LEDS 40 are recessed partially below the first reflective plane 62 and completely below the second reflective plane 64.

The side reflectors 53 are mirrors that capture and redirect light traveling towards the sides of the assembly 10. Preferably, the side reflectors 53 are substantially planar and are angled to diverge toward the front direction 16 and diverge in the upward direction. That is, the side reflectors diverge from each other as you move away from the LEDs 40. In the illustrated embodiment, each side reflector 53 is angled fourteen degrees when viewed from the top (i.e., the front portion of the side reflector is angled fourteen degrees from the back portion) and is angled about four degrees when view from the front (i.e., the top portion of the side reflector is angled about four degrees from the bottom portion).

The recycling reflector 24 is positioned above the specular reflector and above the lens 30 and diffuser 32. In this regard, it can be seen that the recycling reflector 24 is in front of the lens, while the specular and diffuse reflectors 50,52 are behind the lens 30. As best shown in FIG. 4, in the illustrated embodiment, a lower portion of the recycling reflector 24 is aligned (e.g., co-planar) with an upper portion of the specular reflector 50 such that the recycling reflector 24 is essentially an extension of the specular reflector 50. The recycling reflector 24 collects light that is otherwise wasted and re-directs it high up on the cyclorama.

Various features and advantages of the invention are set forth in the following claims.

The invention claimed is:

1. A cyc light assembly comprising:

a base having a front direction defined by a front opening and a rear direction opposite the front direction;

a lighting element supported by the base and defining a central axis;

a first reflector positioned on a rear side of the lighting element to reflect light toward the front opening; and a lens positioned in the front opening and adapted to bend light from the first reflector, wherein the lens includes a plurality of cylinder lens portions, wherein the central axis intersects a midsection of the first reflector.

2. A cyc light assembly as claimed in claim 1, wherein the first reflector is a specular reflector.

3. A cyc light assembly as claimed in claim 1, wherein the central axis is not intersecting the front opening.

4. A cyc light assembly as claimed in claim 1, wherein the central axis intersects the middle 50% of a length of the first reflector.

5. A cyc light assembly as claimed in claim 1, wherein the central axis intersects the middle 33% of a length of the first reflector.

6. A cyc light assembly as claimed in claim 1, wherein the central axis intersects substantially a midpoint of the first reflector.

7. A cyc light assembly comprising:

a base having a front direction defined by a front opening and a rear direction opposite the front direction;

a lighting element supported by the base and defining a central axis;

a first reflector positioned on a rear side of the lighting element to reflect light toward the front opening; and a lens positioned in the front opening and adapted to bend light from the first reflector, wherein the lens includes a plurality of cylinder lens portions, wherein cylinder lens portions are substantially parallel to each other.

8. A cyc light assembly as claimed in claim 7, wherein cylinder lens portions are substantially horizontally oriented.

9. A cyc light assembly comprising:

a base having a front direction defined by a front opening and a rear direction opposite the front direction;

a lighting element supported by the base and defining a central axis;

a first reflector positioned on a rear side of the lighting element to reflect light toward the front opening;

a lens positioned in the front opening and adapted to bend light from the first reflector, wherein the lens includes a plurality of cylinder lens portions; and a diffuser positioned to cover the front opening.

10. A cyc light assembly as claimed in claim 9, wherein the lens is positioned between the light source and the diffuser.

11. A cyc light assembly comprising:

a base having a front direction defined by a front opening and a rear direction opposite the front direction;

a lighting element supported by the base and defining a central axis;

a first reflector positioned on a rear side of the lighting element to reflect light toward the front opening; and a lens positioned in the front opening and adapted to bend light from the first reflector, wherein the lens includes a plurality of cylinder lens portions; and a recycling reflector positioned in front of the lens and adapted to collect light that is otherwise wasted.

12. A cyc light assembly as claimed in claim 11, wherein a portion of the recycling reflector is aligned with a portion of the first reflector.

13. A cyc light assembly comprising:

a base having a front direction defined by a front opening and a rear direction opposite the front direction;

a lighting element supported by the base and defining a central axis;

a first reflector positioned on a rear side of the lighting element to reflect light toward the front opening; and a lens positioned in the front opening and adapted to bend light from the first reflector, wherein the lens includes a plurality of cylinder lens portions, wherein the assembly further includes a second reflector positioned on a front side of the lighting element to diffusively reflect light toward the front opening, the second reflector being more diffuse than the first reflector.

14. A cyc light assembly as claimed in claim 13, wherein the first reflector includes a curved portion and the second reflector includes a substantially planar portion.

15. A cyc light assembly as claimed in claim 14, wherein the central axis of the lighting element is substantially perpendicular to the substantially planar portion of the second reflector.

16. A cyc light assembly as claimed in claim 13, wherein the second reflector includes a first substantially planar portion positioned adjacent the lighting element and a second substantially planar portion positioned adjacent the lens.

17. A cyc light assembly comprising:

a base having a front direction defined by a front opening and a rear direction opposite the front direction;

a lighting element supported by the base and defining a central axis;

a first reflector positioned on a rear side of the lighting element to reflect light toward the front opening; and a lens positioned in the front opening and adapted to bend light from the first reflector, wherein the lens includes a plurality of cylinder lens portions; and side reflectors positioned on opposing sides of the lighting element to capture and redirect light traveling towards sides of the light assembly.

18. A cyc light assembly as claimed in claim 17, wherein the side reflectors are substantially planar and are angled to diverge from each other toward the front direction.

19. A cyc light assembly as claimed in claim 18, wherein the side reflectors are angled to diverge from each other toward an upward direction away from the lighting element.

* * * * *